US006561482B2

(12) United States Patent
Okii

(10) Patent No.: US 6,561,482 B2
(45) Date of Patent: May 13, 2003

(54) CONTROL VALVE FOR VARIABLE CAPACITY COMPRESSOR

(75) Inventor: Toshiki Okii, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/963,525

(22) Filed: Sep. 27, 2001

(65) Prior Publication Data

US 2002/0043639 A1 Apr. 18, 2002

(30) Foreign Application Priority Data

Oct. 17, 2000 (JP) ..... 2000-316340

(51) Int. Cl.[7] ..... F16K 31/06
(52) U.S. Cl. ..... 251/129.15; 251/129.02
(58) Field of Search ..... 251/129.01–129.22

(56) References Cited

U.S. PATENT DOCUMENTS 4,875,832 A * 10/1989 Suzuki et al. ..... 251/129.18
6,033,189 A * 3/2000 Miura et al. ..... 251/129.15
6,036,447 A * 3/2000 Kawaguchi et al. ... 251/129.15
6,062,823 A * 5/2000 Kawaguchi et al. ... 251/129.15
6,062,824 A * 5/2000 Kimura et al. ..... 251/129.15
6,146,106 A * 11/2000 Suitou et al. ..... 251/129.18
6,224,348 B1 * 5/2001 Fukanuma et al. .... 251/129.13

* cited by examiner

*Primary Examiner*—Paul J. Hirsch
(74) *Attorney, Agent, or Firm*—Rader, Fishman & Grauer PLLC

(57) ABSTRACT

A control valve for a variable capacity compressor comprising a solenoid excitation unit positioned at the center thereof, a control valve body positioned at the upper side of said solenoid excitation unit, and a pressure sensitive unit positioned below said solenoid excitation unit, wherein said control valve body comprises a valve means for opening and closing the passage between a discharge pressure region and an intermediate pressure region of said compressor, said solenoid excitation unit is equipped with a plunger that moves according to excitation, a magnetic drawer, and a bellows for operating said valve means, and said pressure sensitive unit is equipped with a pressure sensitive portion spring for operating said valve means.

6 Claims, 3 Drawing Sheets

CONTROL VALVE FOR VARIABLE CAPACITY COMPRESSOR

FIELD OF THE INVENTION

The present invention relates to a control valve for a variable capacity compressor used in an air conditioning device for vehicles and the like, and more specifically relates to a control valve for a variable capacity compressor that controls according to need the supply of refrigerant gas from a discharge pressure region to an intermediate pressure region of the compressor.

Heretofore, a variable capacity compressor equipped with a cylinder, a piston, a cam plate and the like is used for example to compress and discharge a refrigerant gas in an air conditioning device mounted on a vehicle. A known control valve for the variable capacity compressor comprises a refrigerant gas passage that communicates a discharge pressure region with a crank chamber that is in an intermediate pressure region, and by adjusting the pressure within the crank chamber, the tilt angle of the cam plate is changed so as to vary the discharge capacity. The pressure adjustment within the crank chamber is performed by adjusting the opening of the control valve mounted between the refrigerant passage, thereby supplying a high-pressure compressed refrigerant gas from the discharge pressure region to the crank chamber.

One typical type of control valve mentioned above is shown in FIG. 3 as a control valve 100 for a variable capacity compressor (hereinafter called "control valve") (refer to Japanese Patent Laid-Open Publication No. 2000-120912). The control valve 100 is mounted to the rear housing side of the variable capacity compressor, and mounted via o-rings 121*a*, 121*b*, and 131*b* so as to maintain an airtight state, thereby adjusting the pressure within the crank chamber of a variable capacity compressor.

The control valve 100 comprises a control valve body 120, a solenoid excitation unit 130, and a pressure sensitive unit 145, wherein the solenoid excitation unit 130 is positioned at the center of the control valve 100 and to both sides of the solenoid excitation unit 130 are positioned the control valve body 120 and the pressure sensitive unit 145.

The solenoid excitation unit 130 comprises on the outer circumference thereof a solenoid housing 131, and in the interior of the solenoid housing 131 are positioned a solenoid 131A, a plunger 133 that moves up and down by the excitation of the solenoid 131A, and a magnetic drawer 141. A plunger chamber 130*a* housing the plunger 133 is communicated to a suction refrigerant port 129 equipped to the control valve body 120. Further, the solenoid 131A is connected with a cord (not shown) that is capable of supplying excitation current controlled by a control computer (not shown).

The pressure sensitive unit 145 is positioned below the solenoid housing 131, and in the inside thereof is formed a pressure sensitive chamber 145*a*. The pressure sensitive chamber 145*a* includes a bellows 146 and a pressure sensitive spring 159 that operates the plunger 133 through a stem 138 and the like, and the interior of the pressure sensitive chamber 145*a* is maintained at a vacuum state.

The control valve body 120 comprises a valve chamber 123, and a valve means 132 that opens and closes by the plunger 133 is positioned within the valve chamber 123. A refrigerant gas having a high discharge pressure Pd is introduced to the valve chamber 123 through the discharge pressure region of the compressor and the discharge refrigerant port 126. On the bottom surface of the valve chamber 123 is formed a valve hole 125 that communicates to a crank chamber refrigerant port 128, and the upper space within the valve chamber 123 is sealed by a stopper 124. At the center of the stopper 124 is created a pressure chamber 151 formed as a vertical hole with a bottom having a cross-sectional area equal to the valve hole 125 and opposing to the valve hole 125. The pressure chamber 151 is also formed as a screw storage chamber 151*a*, to the bottom of which is positioned a valve closing spring 127 that biases the valve means 132 toward the bottom surface of the valve chamber 123.

The valve means 132 is a shaft-like body including an upper portion 132*a*, an enlarged valve portion 132*b*, a small-diameter portion 132*c* and a lower portion 132*d*. The upper portion 132*a* and the lower portion 132*d* have the same cross-sectional area as the valve hole 125. The upper portion 132*a* is fit to and supported by the stopper 124 having the pressure chamber 151, the enlarged valve portion 132*b* is positioned inside the valve chamber 123, and the small-diameter portion 132*c* opposes a crank chamber refrigerant port 128 that communicates to a crank chamber (intermediate pressure Pc)within the valve hole 125. The lower portion 132*d* is fit to and supported by the control valve body 120, the end portion of which is inserted to a plunger chamber 130*a* into which a refrigerant gas having a suction pressure Ps is introduced, being contacted to the plunger 133. The valve means 132 moves up and down along with the vertical movement of the plunger 133, and the enlarged valve portion 132*b* of the valve means 132 adjusts the gap between a valve seat 125*a* on the upper surface of the valve hole 125. The low-temperature suction pressure Ps introduced to the plunger chamber 130*a* enters the pressure sensitive portion 145.

The stopper 124 is equipped with a horizontal hole 153 that communicates to the pressure chamber 151, and the horizontal hole 153 communicates the pressure chamber 151 with a gap portion 139 defined by the stopper 124 and the control valve body 120. On the other hand, the control valve body 120 is equipped with a cancel hole 155 that communicates the gap portion 139 with the plunger chamber 130*a* into which the refrigerant gas having a suction pressure Ps enters. Accordingly, the refrigerant gas having a suction pressure Ps inside the plunger chamber 130*a* is introduced to the pressure chamber 151 through the cancel hole 155, and the valve means 132 receives the suction pressure Ps from both the upper and lower portions 132*a* and 132*d*. Moreover, since the upper and lower portions 132*a* and 132*d* of the valve means 132 have the same cross-sectional areas, the suction pressure Ps received from the upper and lower portions 132*a* and 132*d* are balanced and cancelled, so that the valve means 132 will not substantially be influenced by the discharge pressure Pd. Moreover, the valve means 132 includes a small-diameter portion 132*c* positioned near the crank chamber refrigerant port 128 having a crank chamber pressure Pc, so when the valve portion 132*b* of the valve means 132 is seated on the valve seat 125*a*, the valve means 132 will not receive unnecessary pressure even when the pressure Pc within the crank chamber is loaded, since the forces toward the upper and lower directions are balanced.

A plunger 133, to which is fixed the valve means 132, is mounted inside the solenoid housing 131, and the plunger 133 is slidably supported by a pipe 136 that contacts the end portion of the control valve body 120 tightly through an o-ring 134*a*. The upper end 138A of a stem 138 is inserted and fixed to a storage hole 137 formed to the lower end of the plunger 133, and the lower end 138B of the stem 138 is supported slidably against the magnetic drawer so that it protrudes from the upper storage hole 142 of the drawer 141 toward the lower storage hole 143. A valve opening spring 144 is positioned between the plunger 133 and the upper storage hole 142 of the magnetic drawer 141, biasing the plunger 133 toward the direction separating from the magnetic drawer 141.

Further, out of the pair of stoppers 147 and 148 inside the bellows 146 positioned within the pressure sensitive chamber 145*a*, the stopper 147 is mounted to the lower portion 138B of the stem 138, the stopper 147 being able to move away from the stem. A spring 150 biasing the stopper 147 away from the magnetic drawer 141 is positioned between the flange 149 of the stopper 147 and the lower storage hole 143 of the magnetic drawer 141.

When the suction pressure Ps inside the pressure sensitive chamber 145*a* rises, causing the bellows 146 to shrink, the pair of stoppers 147 and 148 come into contact with each other and regulates the disposition of the bellows 146. The maximum disposition of the bellows is set so as to be smaller than the maximum fitting quantity of the lower portion 138B of the stem 138 with the stopper 147 of the bellows 146.

When the operation switch of the air conditioning device is turned on, and if for example the detected temperature is equal to or above a predetermined temperature, the computer orders excitation of the solenoid 131A of the control valve 100. Thereby, the plunger 133 is pulled toward the magnetic drawer 141, the valve means 132 contacting the plunger 133 moves toward the direction to close the valve hole 125, and the flow toward the crank chamber is stopped. On the other hand, the low-temperature refrigerant gas is introduced from said suction pressure region into the pressure sensitive portion 145 through the suction refrigerant port 129 and the plunger chamber 130*a* of the control valve body 120. The bellows 146 at the pressure sensitive portion 145 is displaced based on the pressure of the refrigerant gas at a suction pressure Ps, and the displacement is transmitted via the stem 138 and the plunger 133 to the valve means 132. In other words, the opening position of the valve means 132 against the valve hole 125 is determined by the suction force of the solenoid 131A, the bias force of the bellows 146, and the bias force of the valve closing spring 127 and the valve opening spring 144.

When the pressure (suction pressure Ps) within the pressure sensitive chamber 145*a* rises, the bellows 146 contracts, and since the contraction direction corresponds to the direction in which the solenoid 131A pulls the plunger 133, the displacement of the bellows 146 is followed by the movement of the valve means 132, and the opening of the valve hole 125 reduces. Thereby, the amount of high-pressure refrigerant gas introduced from the discharge pressure region into the valve chamber 123 is reduced (the crank chamber pressure Pc drops), and the tilt angle of the cam plate is increased. Moreover, when the pressure within the pressure sensitive chamber 145*a* falls, the bellows 146 expands by the restoration force of the pressure sensitive portion spring 159 and the bellows 146 itself, the valve means 132 moves in the direction to increase the opening of the valve hole 125, increasing the amount of high-pressure refrigerant gas to be introduced to the valve chamber 123 (increasing the crank chamber pressure Pc), and the tilt angle of the cam plate is reduced.

On the other hand, when the heat load becomes smaller, the high-pressure refrigerant gas flows from the discharge pressure region into the crank chamber at the intermediate pressure region, the pressure within the crank chamber rises, and the tilt angle of the cam plate becomes smaller.

In case the pressure difference between the discharge pressure region and the crank chamber becomes smaller than the predetermined value, the flow of refrigerant from the compressor to the condenser is blocked. As explained, when the heat load becomes smaller and the solenoid 131A is demagnetized, the suction against the plunger 133 is stopped, and by the bias force of the valve opening spring 144, the plunger 133 moves toward the direction separating from the magnetic drawer 141, the valve means 132 moves toward the direction releasing the valve hole 125 of the control valve body 120, and the flow toward the crank chamber is accelerated.

When the pressure within the pressure sensitive chamber 145 rises, the bellows 146 contracts, and the opening of the valve means 132 reduces. However, since the lower portion 138B of the stem 138 is removably fit to the stopper 147 of the bellows 146, the displacement of the bellows 146 will not influence the valve means 132.

SUMMARY OF THE INVENTION

With regard to the above-mentioned prior-art control valve 100, it is required to reduce the size of the control valve in order to create a small-sized variable capacity compressor to be used in the air conditioning device of a vehicle.

One way to reduce the size of the control valve 100 is to reduce the number of turns (winding number) of the coil of the solenoid 131A. When considering that the solenoid 131A works as the reaction force at the pressure sensitive side, the reduction of the winding number of the coil in the solenoid 131A leading to the miniaturization of the control valve can be achieved by reducing the size of the pressure sensitive chamber 145*a*, in other words, by reducing the diameter of the bellows 146, and by reducing the size of the pressure sensitive portion spring 159.

However, there is a limit in reducing the space for positioning the pressure sensitive portion spring 159 in the pressure sensitive chamber 145*a*. For example, if the refrigerant gas being introduced to the compressor has a high pressure of approximately 10 times the normal value, it is difficult to reduce the size of the spring 159 in the pressure sensitive portion. Therefore, there is a need to provide some kind of solution in order to reduce the winding number of the coil of the solenoid 131A that leads to reducing the size of the control valve without mainly changing the spring 159, but the conventional control valve 100 lacks such solution.

The present invention takes the above problems into consideration, and the object of the invention is to provide a control valve for a variable capacity compressor capable of reducing the size of a control valve comprising a spring in the pressure sensitive portion and a bellows.

In order to achieve the above objects, the control valve for a variable capacity compressor according to the present invention comprises a solenoid excitation unit positioned at the center thereof, a control valve body positioned above said solenoid excitation unit, and a pressure sensitive unit positioned below said solenoid excitation unit: wherein the control valve body is equipped with a valve means for opening and closing the passage between a discharge pressure region and an intermediate pressure region of the compressor; the solenoid excitation unit is equipped with a plunger that moves according to excitation, a magnetic drawer, and a bellows for operating the valve means; and the pressure sensitive unit comprises a pressure sensitive unit spring for operating the valve means.

The control valve for a variable capacity compressor mentioned above according to the present invention comprises a bellows that is arranged within the solenoid excitation unit and is separated from the pressure sensitive unit spring in the pressure sensitive unit. This feature of the invention enables the diameter of the bellows to be reduced without having to change the design of the pressure sensitive unit spring, and by reducing the diameter of the bellows the winding number of the solenoid is necessarily reduced, which leads to reducing the overall size of the control valve for a variable capacity compressor.

Moreover, in a preferable embodiment of the control valve for a variable capacity compressor according to the present invention, the pressure sensitive unit is equipped with an atmospheric pressure introducing hole.

Furthermore, in another preferable embodiment of the control valve for a variable capacity compressor according to the present invention, the bellows is arranged along the same axis as the pressure sensing unit spring, or the bellows has a length so as to be extended to both the plunger and the magnetic drawer, or the solenoid excitation unit is equipped with a centralization mechanism positioned at the control valve body side of the bellows.

Even further, the solenoid excitation unit communicates with the suction pressure region of the compressor at the upper end of the control valve body.

DETAILED DESCRIPTION OF PREFERRED EMBODIMENTS

A preferred embodiment of the control valve for a variable capacity compressor according to the present invention will now be explained with reference to the drawings.

Figure 1:
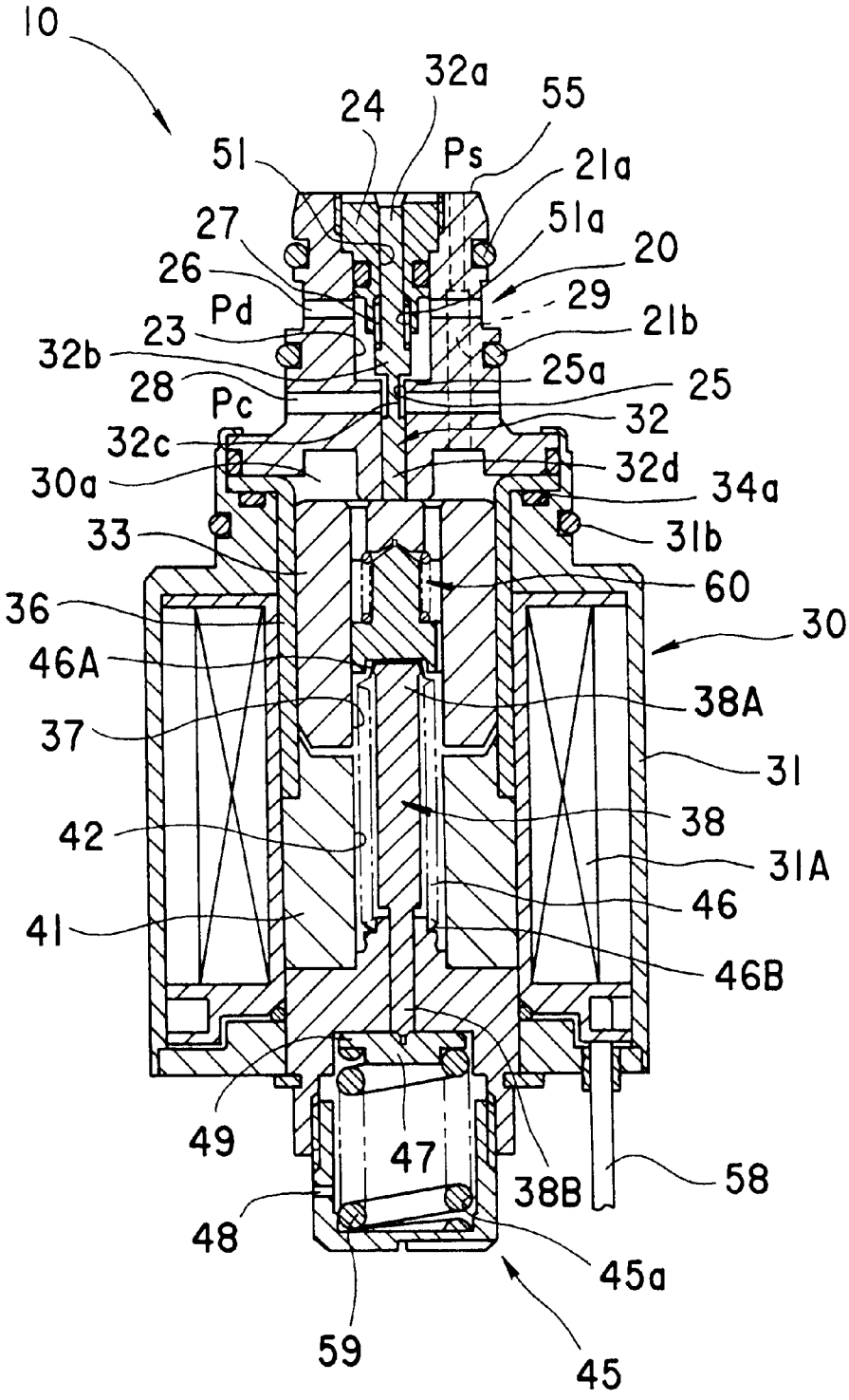
FIG. 1 is a vertical cross-sectional view showing the control valve for a variable capacity compressor according to the present embodiment.
Figure 2:
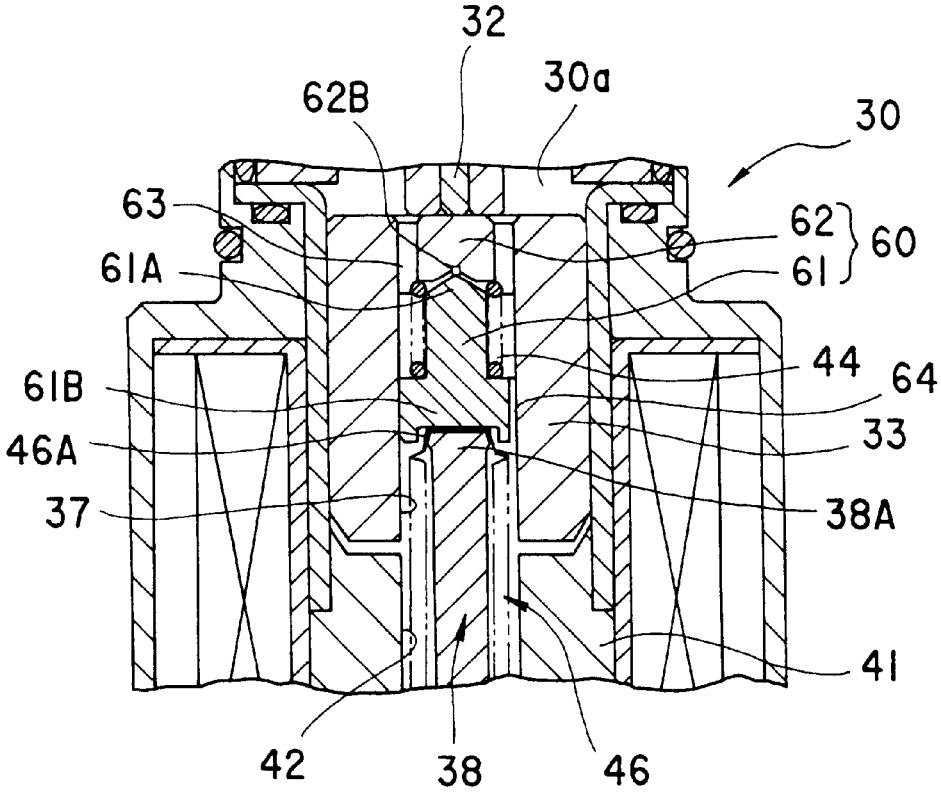
FIG. 2 is a partially enlarged vertical cross-sectional view of the control valve for a variable capacity compressor according to FIG. 1.
Figure 3:
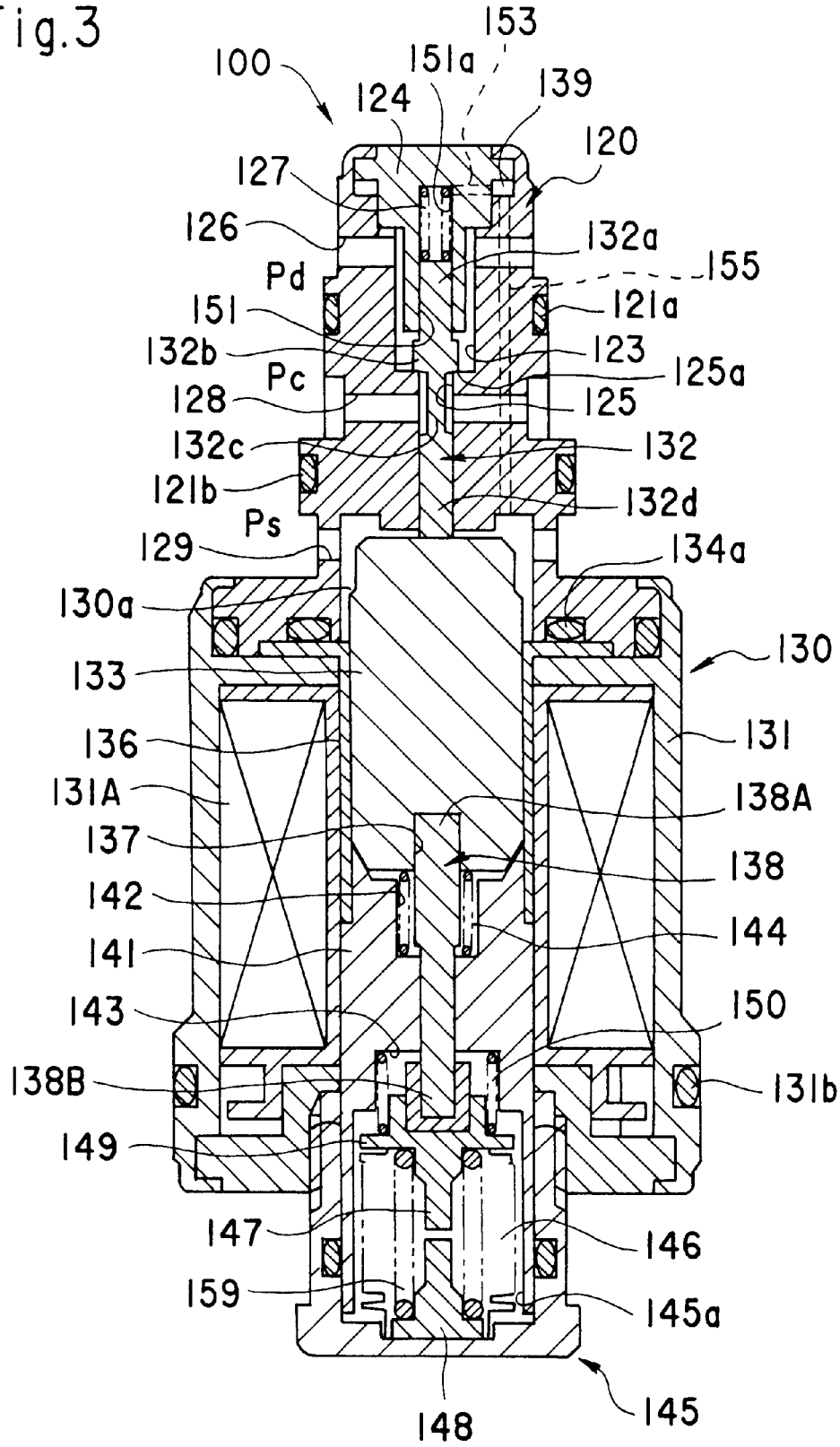
FIG. 3 is a vertical cross-sectional view of the control valve for a variable capacity compressor according to the prior art.

FIG. 1 and FIG. 2 show a control valve 10 for a variable capacity compressor according to the present embodiment (hereinafter called "control valve"), wherein FIG. 1 shows a vertical cross-sectional view of the control valve 10, and FIG. 2 is a partially enlarged vertical cross-sectional view thereof.

The variable capacity compressor that compresses and discharges refrigerant gas in an air conditioning device for a vehicle is equipped with a cylinder, a piston, a cam plate and the like, and further comprises a refrigerant gas passage that communicates a discharge pressure region and a crank chamber that is in an intermediate pressure region. The control valve 10 is mounted in the middle of the refrigerant gas passage. By adjusting the opening of the control valve 10, a compressed refrigerant gas having high pressure is supplied to the crank chamber from the discharge pressure region, thereby controlling the pressure within the crank chamber.

The control valve 10 is positioned in the rear housing side of the compressor, and it is mounted in an airtight manner within the rear housing via o-rings 21*a*, 21*b*, and 31*b*. The control valve 10 comprises a control valve body 20, a solenoid excitation unit 30, and a pressure sensitive unit 45, wherein the solenoid excitation unit 30 is positioned at the center area of the control valve 10, to both sides of which are positioned the control valve body 20 and the pressure sensitive unit 45, respectively.

The solenoid excitation unit 30 comprises on the outer circumference a solenoid housing 31, and in the interior of the solenoid housing 31 are positioned a solenoid 31A, a plunger 33 that moves up and down by the excitation of the solenoid 31A, and a magnetic drawer 41. A plunger chamber 30*a* housing the plunger 33 is communicated to an intake refrigerant port 29 equipped to the control valve body 20. Further, the solenoid 31A is connected with a cord 58 that supplies excitation current controlled by a control computer (not shown).

Further, with connection to the solenoid excitation unit 30 as mentioned later, a bellows 46, being separated from a spring 59 of the pressure sensitive unit 45, for operating the valve means 32 is positioned inside a plunger 33 and a magnetic drawer 41, and is mounted along the same axis as the spring 59 of the pressure sensitive unit.

As is shown in FIG. 1, the pressure sensitive unit 45 is positioned below the solenoid housing 31, and a pressure sensitive chamber 45*a* is formed to the interior of said unit. A spring 59 for operating the plunger 33 through the stem 38 and the like is positioned within the pressure sensitive chamber 45*a*. Moreover, the pressure sensitive unit 45 is equipped with an atmospheric pressure introducing hole 48 for introducing atmosphere into the pressure sensitive chamber 45*a*.

The control valve body 20 comprises a valve chamber 23, and a valve means 32 that is driven to open and close by the plunger 33 positioned in the valve chamber 23. A refrigerant gas having a high-pressure of discharge pressure Pd is introduced to the valve chamber 23 through the discharge pressure region of the compressor and the discharge refrigerant port 26. A valve hole 25 is formed to the bottom surface of the valve chamber 23 that communicates to the crank chamber refrigerant port 28, and a stopper 24 closes the upper space of the valve chamber 23. At the lower end of the stopper 24 is provided a pressure chamber 51 formed as a vertical hole with a bottom and having a cross-sectional area equal to the valve hole 25 and opposing to the valve hole 25. The pressure chamber 51 is also formed as a screw storage chamber 51*a*, to the bottom of which is placed a valve closing spring 27 that biases the valve means 32 toward the bottom surface of the valve chamber 23.

The valve means 32 is a shaft-like body having an upper portion 32*a*, an enlarged valve portion 32*b*, a small-diameter portion 32*c* and a lower portion 32*d*. The upper portion 32*a* and the lower portion 32*d* have the same cross-sectional areas as the valve hole 25. The upper portion 32*a* is fit to and supported by the stopper 24 with the pressure chamber 51, the enlarged valve portion 32*b* is positioned inside the valve chamber 23, and the small-diameter portion 32*c* opposes to a crank chamber refrigerant port 28 that communicates to a crank chamber (intermediate pressure Pc) within the valve hole 25. The lower portion 32*d* is fit to and supported by the control valve body 20, the end of which is inserted to a plunger chamber 30*a* to which a refrigerant gas having a suction pressure Ps is introduced, coming into contact with a centralization mechanism 60 that moves along with the plunger 33. The valve means 32 moves up and down by the vertical movement of the plunger 33, and the enlarged valve portion 32*b* of the valve means 32 adjusts the gap between a valve seat 25*a* on the upper surface of the valve hole 25.

The valve chamber 51 of the stopper 24 is communicated at its upper end with a suction pressure region of the compressor. In other words, the control valve body 20 is communicated with the suction pressure region of the compressor at its upper end 55, and the body 20 further comprises a suction refrigerant port 29 formed in the horizontal direction communicating the upper end 55 of the valve body 20 with the plunger chamber 30*a* of the solenoid excitation unit 30. Therefore, the refrigerant gas having suction pressure Ps is introduced to the pressure chamber 51, and the valve means 32 receiving suction pressure Ps from both the upper and lower portions 32*a* and 32*d*. Since the upper and lower portions 32*a* and 32*d* are set to have the same cross-sectional areas, the suction pressure Ps received from both the upper and lower portions 32*a* and 32*d* are balanced and cancelled, so that the valve means 32 is substantially not effected by the discharge pressure Pd. Moreover, the valve means 32 includes a small-diameter portion 32*c* placed near the crank chamber refrigerant port having a crank chamber pressure Pc, so that when the valve 32*b* of the valve means 32 is seated at the valve seat 25*a*, unnecessary force will not influence the valve means 32 even when the crank chamber pressure Pc is received since the forces from the upper and lower directions are balanced.

Moreover, a plunger 33 having a centralization mechanism 60 that contacts the valve means 32 is positioned within the solenoid housing 31, and the plunger 33 is slidably supported by a pipe 36 that connects to the end of the control valve body 20 via an o-ring 34*a*. A stem 38 is positioned in a storage hole 42 formed to the inside of the storage hole 37 and the magnetic drawer 41 formed to the interior of the plunger 33, and a bellows 46 is placed outside the stem 38.

The bellows 46 has a smaller diameter compared to the bellows 146 used in the conventional control valve 100, enabling to reduce the size of the control valve 10, and it is formed longer than the bellows 146 of the conventional valve 100, extending between both the plunger 33 and the magnetic drawer 41 so as to improve the durability of the bellows. The lower end portion 46B of the bellows 46 is welded and fixed to the lower end portion of the solenoid excitation unit 30. Further, the upper end portion 46A of the bellows 46 is sandwiched between the upper portion 38A of the stem 38 and the lower end portion 61B of a lower pilot portion 61 explained later.

As is shown in FIG. 2, the centralization mechanism 60 is positioned above the upper portion 38A of the stem 38, preventing malfunction of the valve means 32 caused by the buckling of the long and narrow bellows 46. In other words, the centralization mechanism 60 comprises a lower pilot portion 61 and an upper pilot portion 62, and the upper pilot portion 62 is formed integrally with the plunger 33, moving up and down together with the plunger 33. Further, to both sides of the upper pilot portion 62 of the plunger 33 are formed refrigerant introducing holes 63 that communicate the plunger chamber 30*a* with the storage hole 37 of the plunger 33. Further, a refrigerant introducing slit 64 is formed to the lower pilot portion 61, communicating the plunger chamber 30*a* with the storage hole 42 of the magnetic drawer 41.

The upper portion 38A of the step 38 is connected via the upper portion 46A of the bellows 46 to the lower end 61B of the lower pilot portion 61. A pilot protrusion 61A of the lower pilot portion 61 is connected with a pilot dent 62B of the upper pilot portion 62 so as to realize the centralization function. Further, the upper pilot portion 62 is fit to the valve means 32 at the upper end thereof, transmitting the movement of the plunger 33 to the valve means 32. A valve opening spring 44 for biasing the plunger 33 including the upper pilot portion 62 toward the direction separating from the magnetic drawer 41 is positioned between the lower pilot portion 61 and the upper pilot portion 62.

Moreover, a stopper 47 inside the pressure sensitive portion spring 59 arranged within the pressure sensitive chamber 45*a* is mounted via the flange 49 to the lower portion 38B of the stem 38.

Next, the operation of the variable capacity compressor and the control valve 10 according to the present embodiment will be explained.

The rotary power of the engine mounted on a vehicle rotates the cam plate of the compressor. By the rotation of the cam plate, the capacity within the crank chamber changes, and the change in the volume enables the suction, the compression and the discharge of the refrigerant gas to be performed sequentially, and the amount of refrigerant gas corresponding to the tilt angle of the cam plate is discharged.

When the operating switch of the air conditioning device is on, and when the detected temperature exceeds the set temperature, the computer orders excitation of the solenoid 31A of the control valve 10, based on which the plunger 33 is pulled toward the magnetic drawer 41, along with which the valve means 32 contacting the centralization mechanism 60 moves toward closing the valve hole 25, and the flow of the refrigerant gas from the crank chamber is blocked. On the other hand, the low-temperature refrigerant gas is introduced from the suction pressure region through the upper end 55 of the control valve body 20 via the suction refrigerant port 29, the plunger chamber 30*a*, the refrigerant introducing hole 63 and the refrigerant introducing slit 64 to the storage hole 37 of the plunger 33 and the storage hole 42 of the magnetic drawer 41. The bellows 46 is displaced based on the pressure of the refrigerant gas at a suction pressure Ps, and this displacement is transmitted to the valve means 32 via the centralization mechanism 60 and the plunger 33. That is, the opening of the valve means 32 against the valve hole 25 is determined by the suction force of the solenoid 31A, the bias force of the bellows, and the bias force of the valve closing spring 27, the valve opening spring 44 and the pressure sensitive portion spring 59.

When the pressure (intake pressure Ps) within the storage hole 37 and storage hole 42 rises, the bellows 46 contracts in the direction corresponding to the direction in which the solenoid 31A pulls the plunger 33, and thus the displacement of the bellows 46 is followed by the movement of the valve means 32, reducing the opening of the valve hole 25. Thereby, the amount of high-pressure refrigerant gas being introduced from the discharge pressure region into the valve chamber 23 is reduced (the crank chamber pressure Pc drops), and the tilt angle of the cam plate is increased. When the pressure within the storage hole 37 and storage hole 42 decreases, the bellows 46 expands according to the pressure sensitive portion spring 59 and the restoration force of the bellows itself, by which the valve means 32 moves toward increasing the opening of the valve hole 25, increasing the amount of high-pressure refrigerant gas introduced into the valve chamber 23 (increasing the crank chamber pressure Pc), and reducing the tilt angle of the cam plate.

On the other hand, when the heat load becomes smaller, the high-pressure refrigerant gas flows from the discharge pressure region into the crank chamber at the intermediate pressure region thereby increasing the pressure within the crank chamber, and the tilt angle of the cam plate is reduced.

At this time, when the pressure difference between the discharge pressure region and the crank chamber drops to or below a predetermined value, the flow of refrigerant gas from the compressor to the condenser is stopped. When the heat load is reduced and the solenoid 31A is demagnetized, the suction force pulling the plunger 33 disappears, and the plunger 33 moves away from the magnetic drawer 41 by the bias force of the valve opening spring 44. Accompanied by the movement, the valve means 32 moves toward the direction releasing the valve hole 25 of the control valve body 20, and the flow to the crank chamber is accelerated.

As explained, the control valve 10 according to the present embodiment comprises a solenoid excitation unit 30 positioned at the center thereof, a control valve body 20 positioned above the solenoid excitation unit 30, and a pressure sensitive unit 45 positioned below the solenoid excitation unit 30, wherein the control valve body 20 is equipped with a valve means 32 for opening and closing the discharge pressure region and the intermediate pressure region of the compressor. Further, the solenoid excitation unit 30 comprises a plunger 33 that moves by excitation, a magnetic drawer 41, and a bellows 46 for operating the valve means 32. The pressure sensitive unit 45 is equipped with a pressure sensitive unit spring 59 for operating the valve means 32, and an atmospheric pressure introducing hole 48. Since the bellows 46 is positioned in the solenoid excitation unit 30 and is separated from the pressure sensitive unit spring 59, the design of the units can be changed easily, and for example the diameter of the bellows 46 can be reduced regardless of the design of the pressure sensitive unit spring 59. Accompanying this change in design, the winding number of the solenoid 31A can be reduced, thereby providing a control valve 10 that is smaller than the conventional control valve 100, wherein the width of the solenoid 31A is reduced by approximately 20 percent, and the whole length of the control valve is cut to approximately ⅔ of the conventional valve.

Moreover, since the bellows 46 positioned within the solenoid excitation unit 30 is arranged serially along the same axis as the pressure sensitive unit spring 59, and set to have a length enabling it to extend between both the plunger 33 and the magnetic drawer 41, so the durability of the bellows 46 is improved even when the diameter thereof is reduced. Further, since a centralization mechanism 60 is equipped to the control valve body 20 side of the bellows 46 preventing buckling of the bellows 46 and transmitting force toward the center axis, the opening/closing of the valve means 32 can be performed securely.

Further, the solenoid excitation unit 30 is communicated with the suction pressure region of the compressor via the suction pressure introduction port 29 extending downward from the upper end 55 of the control valve body 20, so compared to the control valve 100 of the prior art, the area for placing a suction refrigerant port 129 can be eliminated, and the size of the control valve can be further reduced.

As explained, the control valve for a variable capacity compressor according to the present invention comprises a bellows that is separated with the pressure sensitive unit, enabling the diameter of the bellows to be set smaller and the winding number of the solenoid to be reduced, thereby realizing a smaller conventional valve.

I claim:

1. A control valve for a variable capacity compressor comprising a solenoid excitation unit positioned at the center thereof, a control valve body positioned above said solenoid excitation unit, and a pressure sensitive unit positioned below said solenoid excitation unit: wherein said control valve body is equipped with a valve means for opening and closing the passage between a discharge pressure region and an intermediate pressure region of said compressor;

said solenoid excitation unit is equipped with a plunger that moves according to excitation, a magnetic drawer, and a bellows for operating said valve means; and said pressure sensitive unit comprises a pressure sensitive unit spring for operating said valve means.

2. A control valve for a variable capacity compressor according to claim 1, wherein said pressure sensitive unit is equipped with an atmospheric pressure introducing hole.

3. A control valve for a variable capacity compressor according to claim 1, wherein said bellows is arranged along the same axis as said pressure sensitive unit spring.

4. A control valve for a variable capacity compressor according to claim 1, wherein said bellows is set to have a length so as to be extended to both said plunger and said magnetic drawer.

5. A control valve for a variable capacity compressor according to claim 4, wherein said solenoid excitation unit is equipped with a centralization mechanism positioned at the control valve body side of said bellows.

6. A control valve for a variable capacity compressor according to claim 1, wherein said solenoid excitation unit communicates with the suction pressure region of said compressor at the upper end of said control valve body.

* * * * *